United States Patent [19]

Kato

[11] Patent Number: 4,723,467

[45] Date of Patent: Feb. 9, 1988

[54] AUTOMATIC RHYTHM PERFORMING APPARATUS

[75] Inventor: Mitsumi Kato, Hamamatsu, Japan

[73] Assignee: Nippon Gakki Seizo Kabushiki Kaisha, Hamamatsu, Japan

[21] Appl. No.: 760,351

[22] Filed: Jul. 29, 1985

Related U.S. Application Data

[62] Division of Ser. No. 546,892, Oct. 31, 1983, Pat. No. 4,554,854.

[30] Foreign Application Priority Data

Nov. 8, 1982 [JP] Japan ..... 57-169087

[51] Int. Cl.[4] ..... G10H 1/42; G10H 1/46

[52] U.S. Cl. ..... 84/1.03; 84/1.27; 84/DIG. 12

[58] Field of Search ..... 84/1.03, 1.27, DIG. 12

[56] References Cited

U.S. PATENT DOCUMENTS 3,972,258 8/1976 Adachi ..... 84/1.03

4,181,059 1/1980 Weber ..... 84/DIG. 12

4,305,319 12/1981 Linn ..... 84/1.27 X 4,586,416 5/1986 Sano ..... 84/1.03

*Primary Examiner*—Stanley J. Witkowski

*Attorney, Agent, or Firm*—Spensley Horn Jubas & Lubitz

[57] ABSTRACT

An automatic rhythm performing apparatus capable of producing a rhythmic tone of a plural-tone-source rhythmic musical instrument such as a snare drum comprises a plurality of signal producing devices which produce a plurality of rhythmic tone signals corresponding to the respective tone sources of the single instrument. A control device controls respective signal levels of the rhythmic tone signals and a combining device combined the rhythmic tone signals at signal levels controlled by the control device to provide a combined signal corresponding to the rhythmic tone of the instrument, thereby providing a desired volume relationship of the respective component tones constituting the whole rhythmic tone of the instrument.

2 Claims, 5 Drawing Figures

AUTOMATIC RHYTHM PERFORMING APPARATUS

This is a division of application Ser. No. 546,892 filed on Oct. 31, 1983 and new U.S. Pat. No. 4,554,854.

BACKGROUND OF THE INVENTION

1. Field of the Invention

This invention relates generally to an electronic musical instrument and particularly to an automatic rhythm performing apparatus by which a rhythmic tone corresponding to a rhythmic musical instrument having a plurality of tone sources is produced.

2. Prior Art

Among the rhythmic musical instruments, there are some which comprise plural kinds of tone sources. For example, a snare drum is constituted by two kinds of tone sources one of which is a drum and the other of which are snares. The snare drum produces therefore a tone composed of both a drum tone and a snare tone. Similarly, a tambourine produces a tone composed of both a drum head tone and a jingle tone. And a tam-tam produces a tone composed of a top drum head tone and a bottom drum head tone. It should be noted here that when the snare drum is beaten softly the snare tone sounds louder than the drum tone. On the contrary, when the snare drum is beaten strong the drum tone sounds louder than the snare tone. Like this, relative intensity in volume of the respective tone sources is not constant but variable according to tone volume of the plural-tone-source rhythmic instruments.

In a conventional automatic rhythm performing apparatus, such plural-tone-source rhythmic tone as a snare drum tone is produced based on data obtained from a sampled waveform of a tone actually produced by a snare drum and stored in an associated waveform memory. The data stored in the waveform memory may be replaced by data representing a waveform of a composite tone signal obtained by combining a drum tone signal with a snare tone signal. This conventional automatic rhythm performing apparatus is disadvantageous however in that when volume of the snare drum tone is to be increased or decreased by controlling level of a signal generated from the waveform data, volume of the drum head tone and volume of the snare tone vary at the same rate, so that the snare drum tone sounds odd. The same is true with the other rhythmic tones of plural-tone-source instruments such as a tambourine and a tam-tam.

SUMMARY OF THE INVENTION

It is therefore an object of this invention to provide an automatic rhythm performing apparatus capable of producing a rhythmic tone corresponding to a rhythmic musical instrument having a plurality of tone sources in which the optimum or preferable volume relationship of tones of the tone sources is attained even when volume of the rhythmic tone is varied.

According to one aspect of the present invention, there is provided an automatic rhythm performing apparatus capable of producing a rhythmic tone corresponding to a rhythmic musical instrument and constituted by a plurality of tone sources comprising: a plurality of means each for producing a rhythmic tone signal corresponding to a specific tone source of a certain rhythmic musical instrument; means for controlling signal levels of the respective rhythmic tone signals of the producing means; and means for combining respective outputs of the producing means at signal levels controlled by the control means thereby to provide a combined signal corresponding to a rhythmic tone of the certain rhythmic musical instrument.

BRIEF DESCRIPTION OF THE DRAWINGS

FIG. 5 is a block diagram of a modified automatic rhythm performing apparatus according to the present invention.

DESCRIPTION OF THE PREFERRED EMBODIMENTS OF THE INVENTION

Figure 1:
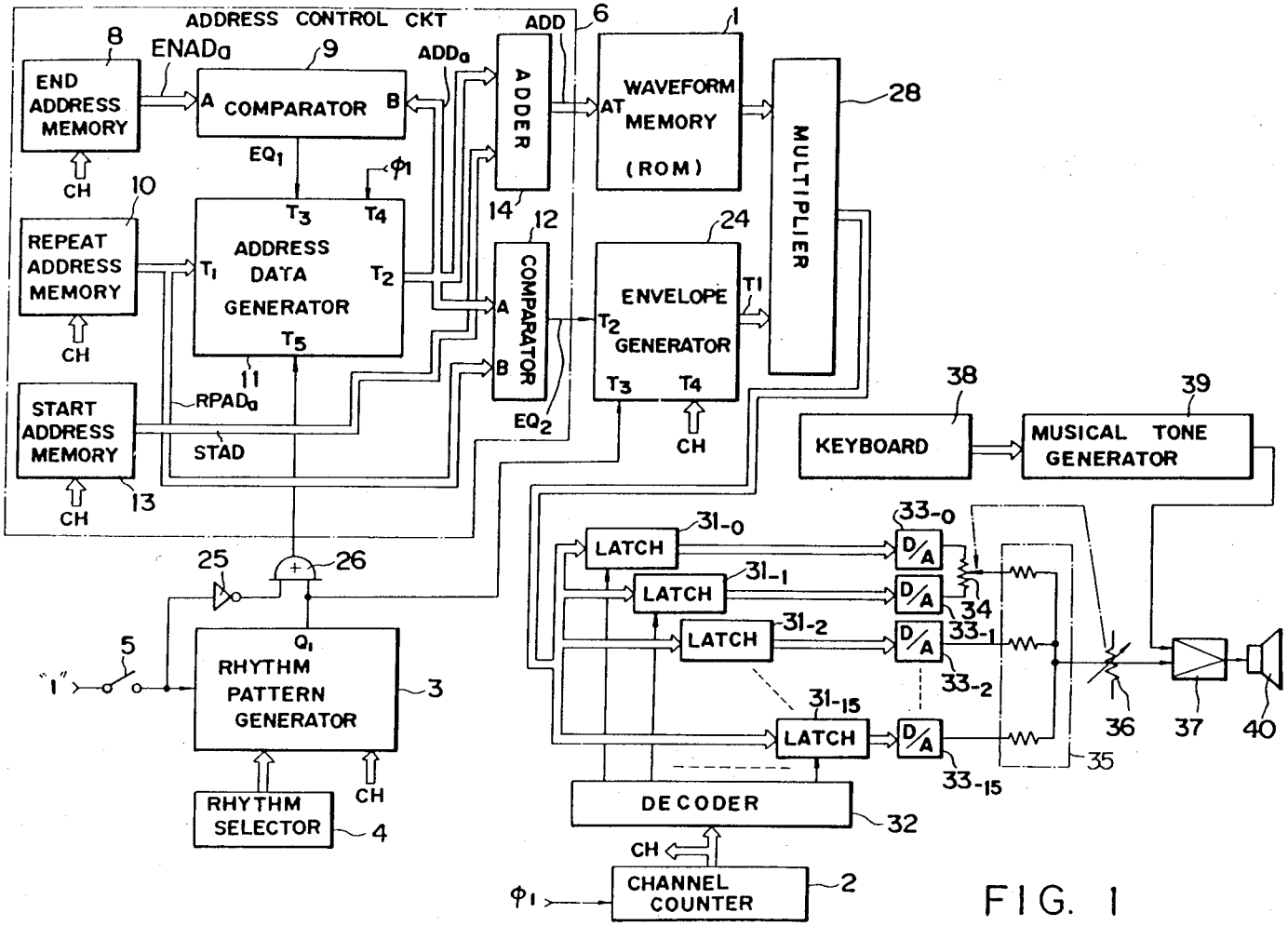
FIG. 1 is a block diagram of an automatic rhythm performing apparatus showing an embodiment of the present invention.

FIG. 1 is a block diagram of an automatic rhythm performing apparatus according to an embodiment of the present invention which is capable of generating rhythmic tones including a snare drum tone. This apparatus is so designed to produce the rhythmic tones corresponding to fifteen kinds of rhythmic musical instruments such as a snare drum, a bass drum and maracas in accordance with sixteen kinds of rhythmic tone waveforms stored in a waveform memory 1. Two kinds of waveform data respectively representing drum tone and snare tone are stored in the waveform memory 1 with respect to a snare drum tone while one kind of waveform data is stored in the waveform memory 1 with respect to each of the rhythmic tones other than the snare drum tone. With this arrangement, associated circuits of this apparatus are operated in a time-sharing manner enabling to produce the fifteen kinds of rhythmic musical instrument tones simultaneously.

Figure 2:
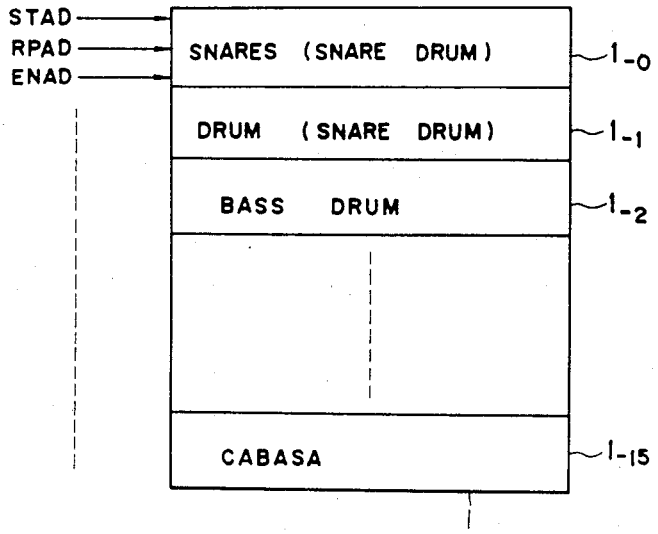
FIG. 2 is an illustration showing the waveform memory of the apparatus of FIG. 1.
Figure 3:
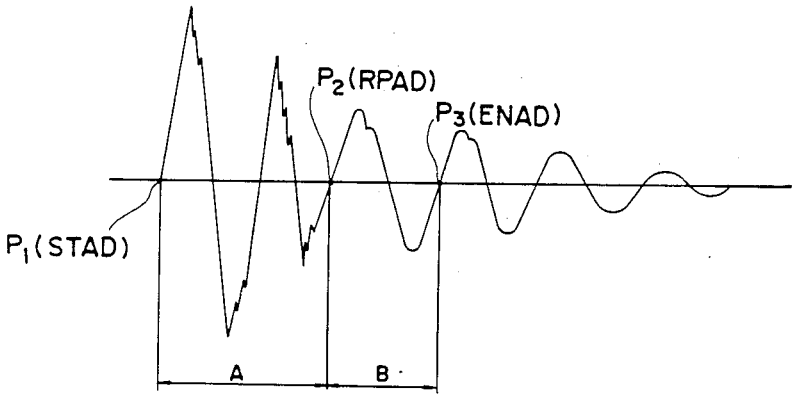
FIG. 3 is a diagrammatical illustration showing a waveform of a rhythm tone.

Now this automatic rhythm performing apparatus will be described in more detail. The waveform memory 1 comprises a ROM having sixteen storage areas $1_{-0}$ to $1_{-15}$, as shown in FIG. 2, in which sixteen kinds of rhythmic tone waveforms corresponding respectively to the snare tone, the drum tone, the bass drum tone, the maracas tone, . . . , and the cabasa tone are stored. Each of the waveforms of the sixteen kinds of rhythmic tones is stored in the waveform memory 1 in the form of digital data representing not the whole but a certain portion thereof. More specifically, with reference to FIG.3 illustrating a waveform of such a rhythmic tone, preselected instantaneous values of the attack portion A of the waveform are consecutively stored in a predetermined one of the areas $1_{-0}$ to $1_{-15}$ of the waveform memory 1. With respect to the other portion of the waveform following the portion A, preselected instantaneous values of the portion B or one cycle following the portion A of the waveform are consecutively stored in the other area of the waveform memory 1 following the area in which the instantaneous values of the attack portion A are stored. The lowest address of each of the areas $1_{-0}$ to $1_{-15}$ in which the data representing an instantaneous value at the beginning point P1 of the portion A is stored is hereinafter referred to as start address STAD. The address of each of the areas $1_{-0}$ to $1_{-15}$ in which the data representing an instantaneous value at the beginning point P2 of the portion B is stored is hereinafter referred to as repeat address RPAD, while the address in which the data representing an instantaneous value at the ending point P3 of the portion B is stored is hereinafter referred to as end address ENAD. When it is required to form the rhythmic tone, the data representative of the instantaneous values of the attack portion A are read from the memory 1 first and then the data representative of the instantaneous values of the portion B are repetitively read from the memory 1. An amplitude envelope is then applied to those read out data to form the rhythmic tone. The above-described manner in which the data are stored in the waveform memory 1 is helpful to reduce the storage capacity thereof.

A channel counter 2 is a binary four-stage counter for counting up clock pulses $\phi_1$, and the output of this counter 2 which varies in the range of "0" to "15" is applied to the associated circuits as a channel signal CH. The values "0" to "15" of this channel signal CH correspond to the following rhythmic tones, respectively:

0: snare tone of the snare drum
1: drum tone of the snare drum
2: bass drum tone
3: maracas tone

.
.
.

15: cabasa tone

The associated circuits are operated in accordance with the values "0" to "15" of the channel signal CH to form the respective rhythmic tones.

A rhythm pattern generator 3 generates sixteen kinds of rhythm pulses corresponding respectively to the sixteen kinds of rhythmic tones. The pattern of each of the rhythm pulses (rhythm pattern) is determined by the kind of rhythm selected by a rhythm selector 4, such as waltz, rhumba and mambo. In this case, the rhythm patterns of the snare tone and the drum tone are identical to each other. The sixteen kinds of rhythm pulses so generated in the rhythm pattern generator 3 are outputted from its output terminal Q1 in a time-sharing manner in accordance with the channel signal CH. For example, the rhythm pulse corresponding to the snare tone is outputted when the channel signal CH represents "0" and the rhythm pulse corresponding to the drum tone is outputted when the channel signal CH represents "1" while the rhythm pulse corresponding to the cabasa tone is outputted when the channel signal CH represents "15". And each rhythm pulse is generated by turning on a rhythm switch 5, and the generation of the rhythm pulse is stopped by turning off the rhythm switch 5.

An address control circuit 6 is provided for generating address data ADD, which is used to read the respective waveform data from the waveform memory 1, and a coincidence signal EQ2 which will be described later. This address control circuit 6 comprises an end address memory 8. The end address memory 8 comprises a ROM storing data representative of relative end address ENADa of the sixteen kinds of rhythmic tone waveforms stored in the waveform memory 1. Each relative end address ENADa is a value obtained by subtracting the start address STAD from the actual end address ENAD of each rhythmic tone waveform, i.e., the end address of each area $1_{-0}$ to $1_{-15}$ of the waveform memory 1. The memory 8 is addressed by the channel signal CH to output data representative of the selected relative end address ENADa to an input terminal A of a comparator 9.

A repeat address memory 10 comprises a ROM storing data representative of relative repeat address RPADa of the sixteen kinds of rhythmic tone waveforms stored in the waveform memory 1. Each relative repeat address RPADa is a value obtained by subtracting the start address STAD from the actual repeat address RPAD of each rhythmic tone waveform. The memory 10 is addressed by the channel signal CH to output data representative of the selected relative repeat address RPADa to both an input terminal T1 of an address data generator 11 and an input terminal B of a comparator 12.

A start address memory 13 comprises a ROM storing data representative of the start address STAD of the rhythmic tone waveforms stored in the waveform memory 1. The start address memory 13 is addressed by the channel signal CH to output data representing the selected start address STAD to one data input terminal of an adder 14.

Figure 4:
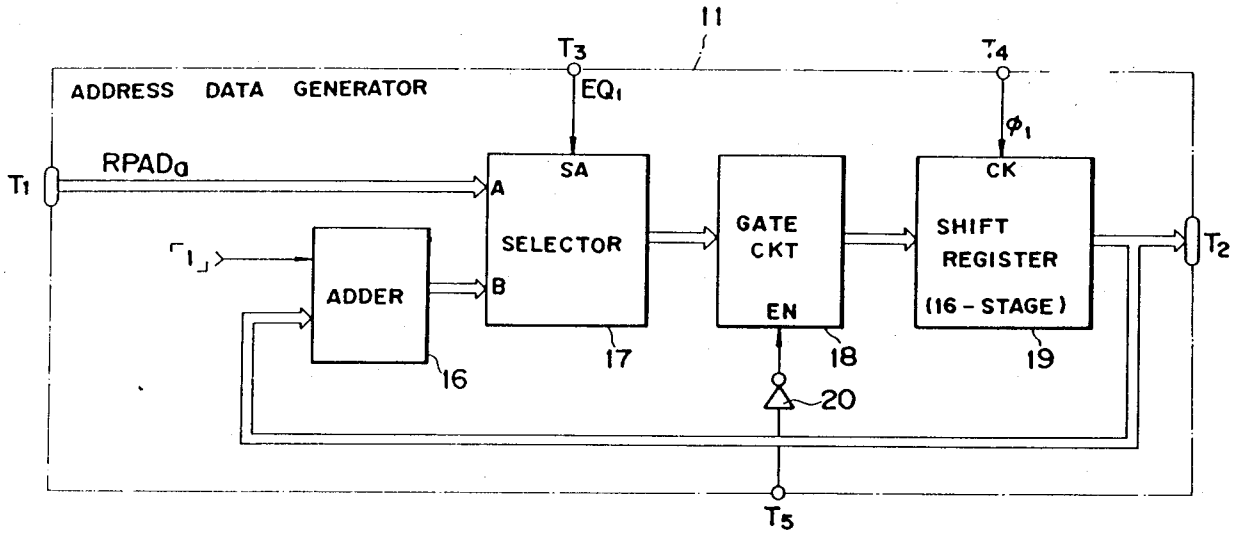

The address data generator 11 comprises an adder 16, a selector 17, a gate circuit 18, a shift register 19 and an inverter 20 as shown in FIG. 4. The adder 16 adds "1" to the output of the shift register 19. The selector 17 selects one of the data applied to its input terminals A and B in accordance with a signal applied to its selector terminal SA, and outputs the selected data. The gate circuit 18 is opened when "1" signal is applied to its enabling terminal EN, and also is closed when "0" signal is applied to the enabling terminal EN. The shift register 19 is a sixteen-stage shift register in which data in each stage is shifted into the next stage by the clock pulse $\phi_1$. The shift register 19 outputs address data ADDa from its output terminal T2 to an input terminal B of the comparator 9 (FIG. 1), to the other data input terminal of the adder 14 and to an input terminal A of the comparator 12.

The comparator 9 compares the relative end address data ENADa with the address data ADDa, and outputs a coincidence signal EQ1 to an input terminal T3 of the address data generator 11 when the two data coincide with each other. The adder 14 adds the address data ADDa to the starting address data STAD and outputs address data ADD to an address input terminal AT of the waveform memory 1. The comparator 12 compares the address data ADDa with the relative repeat address data RPADa, and outputs the coincidence signal EQ2 to a terminal T2 of an envelope generator 24 when the two data coincide with each other.

Now, the operation of the address control circuit 6 will be described. Referring to FIGS. 1 and 4, when the rhythm switch 5 is in the OFF state, an inverter 25 outputs "1" signal. The "1" signal is supplied to an input terminal of the inverter 20 of the address data generator 11 through an OR gate 26. As a result, "0" signal is applied to the enabling terminal EN of the gate circuit 18, therefore the gate circuit 18 is closed, so that data representative of "0" is supplied to the input terminal of the shift register 19. This data representative of "0" is consecutively loaded into each stage of the shift register 19 by the clock pulses $\phi_1$. In other words, when the rhythm switch 5 is in the OFF state, each stage of the shift register 19 is cleared.

When the rhythm switch 5 is turned on, the sixteen kinds of rhythm pulses determined by the output of the rhythm selector 4 are generated in the rhythm pattern generator 3, and are sequentially outputted from the output terminal Q1 thereof in a time-sharing manner in accordance with the channel signal CH.

When the channel counter 2 outputs the channel signal CH representative of "0" the rhythm pattern generator 3 outputs a rhythm pulse corresponding to the snare tone from its output terminal Q1. At this time, if the rhythm pulse of the snare tone is "1" signal, this "1" signal is supplied to the input terminal of the inverter 20 through the OR gate 26, so that the inverter 20 outputs "0". As a result, the gate circuit 18 outputs data representative of "0", and this data is loaded into the shift register 19 by the clock pulse $\phi_1$. The loaded data representative of "0" is outputted from the shift register 19 after fifteen clock pulses $\phi_1$ are counted up, that is to say, when the channel signal CH again represents "0". This data representative of "0" is then applied to the other data input terminal of the adder 14 through the terminal T2 and is also applied to the one data input terminal of the adder 16. At this time, the channel signal CH represents "0", so that data representing the start address STAD of the snare tone waveform area 1-0 is read from the start address memory 13 and is supplied to the one data input terminal of the adder 14. Therefore, when the data representative of "0" is applied to the other data input terminal of the adder 14, this adder 14 outputs the data representing the start address STAD of the snare tone waveform area $1_{-0}$ to the address input terminal AT of the waveform memory 1 as the address data ADD. On the other hand, when the data representative of "0" and outputted from the shift register 19 (FIG. 4) is applied to the one data input terminal of the adder 16, the adder 16 outputs data representative of "1" to the input terminal of the shift register 19 through the selector 17 and the gate circuit 18. This data representative of "1" is loaded into the shift register 19 by the clock pulse $\phi_1$ and is outputted therefrom when the channel signal again represents "0". When the shift register 19 outputs data representing "1", the adder 14 adds the data representative of the start address STAD of the snare tone waveform area $1_{-0}$ to "" to form the address data ADD, and supplies the address data ADD to the waveform memory 1. At this time, the adder 16 outputs data representative of "2". Thereafter, in a manner described above, each time the channel signal represents "0", the adder 14 outputs the address data ADD designating the next address of the snare tone waveform area $1_{-0}$ and applies it to the address input terminal AT of the waveform memory 1. As a result, the waveform data representing the portion A of the snare tone waveform are sequentially read from the waveform memory 1 and are supplied to one data input terminal of a multiplier 28.

When the shift register 19 outputs data identical to the data representing the relative repeat address data RPADa of the snare tone waveform area $1_{-0}$ while the channel signal CH represents "0", the comparator 12 outputs the coincidence signal EQ2 to the terminal T2 of the envelope generator 24. Thereafter, if the address data ADD is further increased when the channel signal CH represents "0", the data representative of the portion B of the snare tone waveform are sequentially read fom the waveform memory 1 and are supplied to the one data input terminal of the multiplier 28. Then, when the shift registe 19 outputs data identical to the data representing the relative end address ENADa of the snare tone waveform area $1_{-0}$, the comparator 9 outputs the coincidence signal EQ1 ("1" signal) to the selector terminal SA of the selector 17 via the terminal T3. As a result, the data representing the relative repeat address RPADa of the snare tone waveform area $1_{-0}$, which is applied to the input terminal A of the selector 17 at this moment, is outputted from the output terminal of the selector 17, and is applied to the input terminal of the shift register 19 through the gate circuit 18. This data representing the relative repeat address RPADa is loaded into the shift register 19 by the clock pulse $\phi_1$,and is outputted therefrom when the channel signal again represents "0". When the shift register 19 outputs data representing the relative repea address RPADa while the channel CH represents "0", the adder 14 adds the data representing the start address STAD of the snare tone waveform area $1_{-0}$ to the data representing the relative repeat address RPADa of the snare tone waveform area $1_{-0}$ to form the address data ADD This address data ADD is supplied to the waveform memory 1, so that the first instantaneous value of the portion B of the snare tone waveform is again read from the waveform memory 1. Thereafter, each time the channel signal CH represents "0", the waveform data representing the portion B of the snare tone waveform are sequentially read from the waveform memory 1. And when the shift register 19 again outputs data identical to the data representative of the relative end address ENADa of the snare tone waveform area $1_{-0}$, the data representative of the relative repeat address RPADa of the snare tone waveform area $1_{-0}$ is loaded into the shift register 19. Then, the above operation is repeated.

Figure 5:
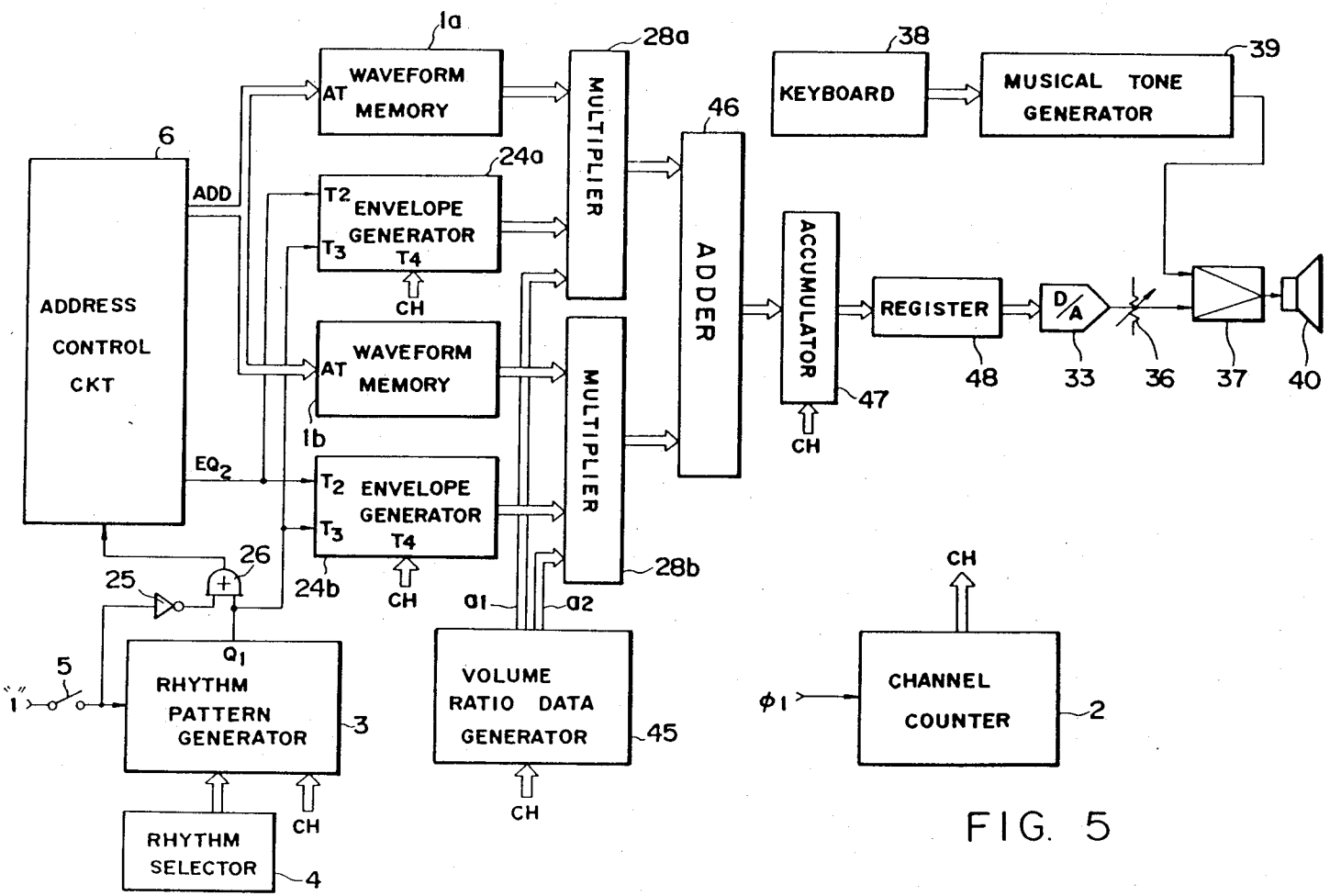
FIG. 5 is a detailed block diagram of the address data generator of the apparatus of FIG. 1.

The foregoing is the operation of the address control circuit 6 during a period when the channel signal represents "0". And a similar operation is carried out when the channel signal CH represents any one of "1" to "15". Therefore, for example, when the channel signal CH represents "1", the data representative of the drum tone waveform is outputted from the waveform memory 1 and when the channel signal CH represents "2", the data representative of the bass drum tone waveform is outputted from the wave memory 1 and also when the channel signal CH represents "15", the data representative of the cabasa tone waveform is outputted from the waveform memory 1. It is apparent from the above description that each of the sixteen kinds of waveform data begins to be read out after the corresponding rhythm pulse ("1" signal) is outputted from the rhythm pattern generator 3. The envelope generator 24 comprises a control circuit and a ROM in which sixteen kinds of envelope data are stored. This envelope generator 24 reads each of the envelope data from the ROM in accordance with the channel signal CH applied to its terminal T4 and outputs the read out envelope data from its terminal T1 to the other data input terminal of the multiplier 28. For example, when the rhythm pulse of "1" is applied to the terminal T3 of the envelope generator 24 while the channel signal CH represents "0", this envelope generator 24 outputs data representative of "1" from its terminal T1. Thereafter, this envelope generator 24 outputs data representative of "1" each time the channel signal CH represents "0". If the coincidence signal EQ2 is applied to the terminal T2 of the envelope generator 24 during the time when the channel signal CH represents "0", the envelope data corresponding to the snare tone is read from the ROM and is outputted from the terminal T1 each time the channel signal represents "0". Thus, the envelope generator 24 outputs the data representative of "1" to the multiplier 28 during the time when the waveform data representing the portion A of the snare tone waveform is read from the waveform memory 1, so that the multiplier 28 outputs the waveform data inputted thereto. On the other hand, the envelope generator 24 sequentially outputs the envelope data corresponding to the snare tone during the time when the waveform data representing the portion B of the snare tone waveform are sequentially read from the waveform memory 1. Thus the amplitude envelope is applied to the waveform data representative of the portion B of the snare tone waveform by the mutiplier 28. A similar operation is carried out when the channel signal CH represents any one other than "0". Therefore, while the channel signal is varied from "0" to "15", the multiplier 28 outputs the waveform data respectively representing the snare tone, the drum tone, the bass drum tone, . . . , and the cabasa tone, and supplies them to the input terminals of latches $31_{-0}$ to $31_{-15}$. These latches $30_{-0}$ to $30_{-15}$ input the output data of the multiplier 28 in accordance with the output signals of a decoder 32 which decodes the channel signal CH. For example, the latch $30_{-0}$ inputs the waveform data representing the snare tone when the channel signal CH represents "0". The latch $30_{-1}$ inputs the waveform data representing the drum tone when the channel signal CH represents "1". And, the latch $30_{-15}$ inputs the waveform data representing the cabasa tone when the channel signal CH represents "15". These waveform data inputted to the latches $31_{-0}$ to $31_{-15}$ are supplied to a digital-to-analog converter $33_{-0}$ to $33_{-15}$, respectively. These converters convert the inputted waveform data into analog signals, thereby forming the corresponding rhythmic tone signals. The rhythmic tone signal outputted from the digital-to-analog converter $33_{-0}$, which represents the snare tone of the snare drum, is applied to one terminal of a manually-operative variable resister 34 while the rhythmic tone signal outputted from the digital-to-analog converter $33_{-1}$, which represents the drum tone of the snare drum, is applied to the other terminal of the variable resistor 34. And a signal appearing at a slider of this variable resistor 34 is supplied to a mixing circuit 35. The variable resistor 34 combines the rhythmic tone signal representing the snare tone with the rhythmic tone signal representing the drum tone at the amplitude ratio determined by the position of its slider, and outputs the combined signal from the slider. The mixing circuit 35 mixes the signal appearing at the slider of the variable resistor 34 and output signals of the digital-to-analog converters $33_{-2}$ to $33_{-15}$ together, and supplies the mixed signal or the mixed rhythmic tone signal to an amplifier 37 through a variable resistor 36 for controlling the total volume of the rhythmic tones. The amplifier 37 mixes the signal applied thereto via the variable resistor 36 with a keyboard musical tone signal generated by a musical tone generator 39 in accordance with the operation of a keyboard 38, and amplifies this mixed signal. The amplified signal is then applied to a loudspeaker 40, so that the rhythmic tones and the keyboard musical tone are produced by the loudspeaker 40. The variable resistor 34 may be arranged in such a manner that it is automatically operated in synchronism with the operation of the variable resistor 36 as indicated by a dot and dash line in FIG. 1. In this case, the volume ratio of the snare tone to the drum tone is automatically varied in accordance with the total volume of the rhythmic tones. FIG. 5 shows another automatic rhythm performing apparatus according to the present invention in which like reference characters denote corresponding parts of the above-mentioned embodiment. A waveform memory la shown in FIG. 5 stores the waveform data representing the snare tone and also stores the waveform data representing various kinds of rhythmic tones other than the drum tone of the snare drum. In contrast, a waveform memory **1*b* only stores the waveform data representing the drum tone of the snare drum. An envelope generator 24*a* comprises a ROM in which a plurality of envelope data corresponding to the waveform data stored in the waveform memory 1*a* are stored. An envelope generator 24*b* also comprises a ROM in which the envelope data corresponding to the drum tone is stored. This envelope generator 24*b* outputs data representative of "1" or the data stored therein only when the channel signal CH represents "0". This envelope generator 24*b* also outputs data representative of "0" when the channel signal CH represents any one of "1" to "15". A volume ratio data generator 45 outputs a pair of data al and a2 for determining the volume ratio of the snare tone to the drum tone when the channel signal CH represents "0". The data a1 and a2 are varied in predetermined relations to each other, such as (a1="1", a2="1"), (a1="0.9", a2="1.1") and (al="0.8", a2="1.2"), in accordance with the selected position of a manually operative switch (not shown) incorporated in the volume ratio data generator 45. The data a1 and a2 both represent "1" when the channel signal CH represents any one of "1" to "15". A multiplier 28*a* makes the product of the output data of waveform memory 1*a* the output data of the envelope generator 24*a* and the data a1, and outputs the product to one data input terminal of an adder 46. A multiplier 28*b* makes the product of the output data of the waveform memory 1*b*, the output data of the envelope generator 24*b* and the data a2, and outputs the product to the other data input terminal of the adder 46. The adder 46 adds the output of the multiplier 28*a* to the output of the multiplier 28*b*, and outputs the result of this addition to an accumulator 47. This accumulator 47 sequentially accumulates the output data of the adder 46 each time the channel signal CH varies from "0" to "15", and outputs the result of this accumulation to a register 48. The register 48 temporarily stores the output data of the accumulator 47, and supplies the stored data to a digital-to-analog converter 33. This digital-to-analog converter 33 converts the data supplied from the register 48 into an analog signal, and supplies the analog signal to the loudspeaker 40 via the variable resistor 36, which is provided for controlling the total volume of the rhythmic tones, and the amplifier 37**.

Now, the operation of this apparatus will be described. When the rhythm pattern generator 3 outputs from its output terminal Q1 the rhythm pulse of "1" while the channel signal CH represents "0", the pulse signal of "" is applied to the address control circuit 6 via the OR gate 26. Thereafter, each time the channel signal CH represents "0", the address control circuit 6 sequentially outputs the address data ADD in synchronism with the clock pulse $\phi_1$ in a manner described for the apparatus shown in FIG. 1. Those outputted address data ADD are supplied to each of address input terminals AT of the waveform memory **1*a* and 1*b*. As a result, the waveform data representative of the snare tone and the drum tone are sequentially read from the waveform memory la and lb and then applied to the first data input terminals of the multipliers 28*a* and 28*b*, respectively. On the other hand, the rhythm pattern generator 3 also outputs the rhythm pulse to the terminals T3 of the envelope generators 24*a* and 24*b* while the channel signal CH represents "0", thereafter, the envelope generators 24a and 24b output the data both representative of "" to the second data input terminals of the multipliers 28a- and 28b-, respectively, each time the channel signal CH represents "0". And, after the address control circuit 6 outputs the coincidence signal EQ2, the envelope generators 24a and 24b output the envelope data corresponding to the snare tone and the drum tone, respectively, each time the channel signal CH represents "0". Also, each time the channel signal CH represents "0", the volume ratio data generaor 45 outputs the data al and a2 corresponding to the selected position of the switch incorporated therein, and supplies them to the third data input terminals of the multiplier 28a and 28b, respectively. Each of the multipliers 28a and 28b makes the product of the three data applied thereto and supplies the product to the adder 46. The adder 46 then adds the product outputted from the multiplier 28a to the product outputted from the multiplier 28b and outputs the result of this addition to the accumulator 47**.

Thus, when the channel signal CH represents "0", the multiplier 28a outputs the data representative of the snare tone while the multiplier 28b outputs the data representative of the drum tone. These two data are then combined by the adder 46 to form the data representative of the snare drum tone. And in this case, the volume ratio of the snare tone to the drum tone is determined by the data al and a2.

The foregoing is the operation of the apparatus shown in FIG. 5 when the channel signal CH represents "0". When the channel signal CH represents any one of "1" to "15", the envelope generator 24b outputs the data representative of "0", so that the multiplier 28b outputs data representative of "0". The output of the multiplier 28b has therefore no effect on the adder 46 when the channel signal CH represents any one of "1" to "15", so that the adder 46 outputs the data representative of the rhythmic tone waveforms stored in the waveform memory 1a to which the respective envelope amplitudes have been applied, in a manner described for the apparatus shown in FIG. 1. And, each time the channel signal CH varies from "0" to "15", the data outputted from the multiplier 46 are accumulated or mixed by the accumulator 47. The accumulated data is converted into the analog signal and then supplied to the loudspeaker 40 to produce the rhythmic tones. The aforementioned volume ratio data generator 45 may also be constructed in such a manner that the data a1 and a2 generated therein are automatically varied in accodance with the resistance of the variable resistor 36 which is adjusted by an operator.

What is claimed is:

1. An automatic rhythm performing apparatus capable of producing a rhythmic tone corresponding to a rhythmic musical instrument and constituted by a plurality of tone sources, comprising:

(a) a plurality of means each for producing a rhythmic tone signal corresponding to a specific single tone source of a certain plural-tone-source rhythmic musical instrument;

(b) control means for manually and non-independently varying signal levels of the respective rhythmic tone signals of said producing means in relation to one another to provide tone signals of desired relative levels;

(c) means for combining respective outputs of said producing means at signal levels controlled by said control means thereby to provide a combined signal corresponding to a rhythmic tone of said certain rhythmic musical instrument; and (d) means for varying the signal level of said combined signal.

2. An automatic rhythm performing apparatus capable of producing a rhythmic tone corresponding to a rhythmic musical instrument constituted by a plurality of tone sources, comprising:

a plurality of tone source means for producing the respective single tone signals constituting said plural-tone-source instrument, control means for simultaneously manually varying the respective levels of said instrument-consisting tone signals in relation to one another to achieve a desired level relationship between the signals; and means for combining said level-controlled tone sources to produce said rhythmic tone.

* * * * *